United States Patent [19]

Dilo

[11] Patent Number: 5,016,331

[45] Date of Patent: May 21, 1991

[54] DEVICE ON NEEDLING MACHINES FOR THE PRODUCTION OF NEEDLE-BONDED FABRIC WEBS OR THE LIKE

[75] Inventor: Johann P. Dilo, Eberbach, Fed. Rep. of Germany

[73] Assignee: Oskar Dilo Maschinenfabrik K.G, Eberbach, Fed. Rep. of Germany

[21] Appl. No.: 359,986

[22] Filed: Jun. 1, 1989

[30] Foreign Application Priority Data

Jul. 18, 1988 [DE] Fed. Rep. of Germany ..... 3824341

[51] Int. Cl.[5] ..... D04H 18/00

[52] U.S. Cl. ..... 28/115

[58] Field of Search ..... 28/107, 109, 110, 111, 28/115

[56] References Cited

U.S. PATENT DOCUMENTS 3,415,713 12/1968 Smith II ..... 28/111 X 4,035,881 7/1977 Zocher ..... 28/111

FOREIGN PATENT DOCUMENTS 265685 10/1968 Austria .

*Primary Examiner*—Werner H. Schroeder

*Assistant Examiner*—Bradley Kurtz DeSandro

*Attorney, Agent, or Firm*—Rosen, Dainow & Jacobs

[57] ABSTRACT

A device on needling machines for the production of needle-bonded fabric webs or the like, having above the fiber fleece to be needled a holding-down means provided with openings for the needles, with plugs of elastic material, to be pierced by the needles, being inserted into the needle openings of said holding-down means, which plugs surround the needle shafts, and their lower faces are flush or approximately flush with the underside of the holding-down means.

11 Claims, 1 Drawing Sheet

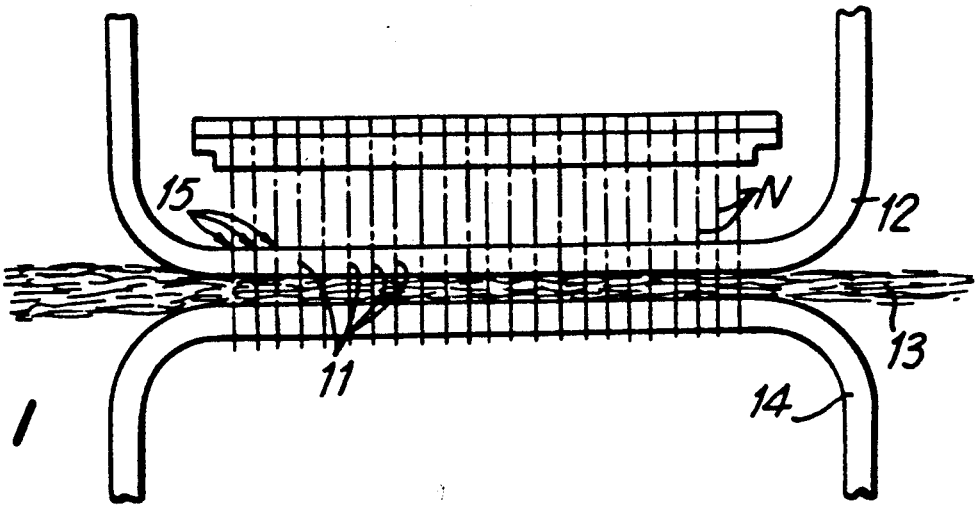
FIG. 1
FIG. 2
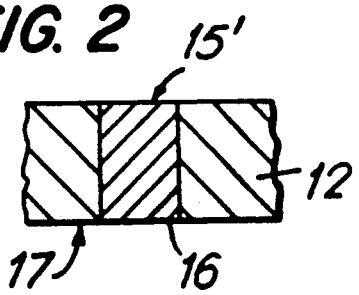
FIG. 3
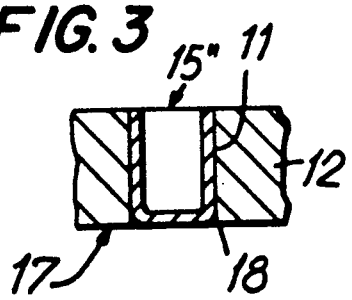
FIG. 4
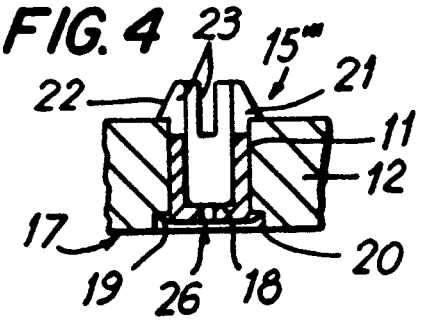
FIG. 5
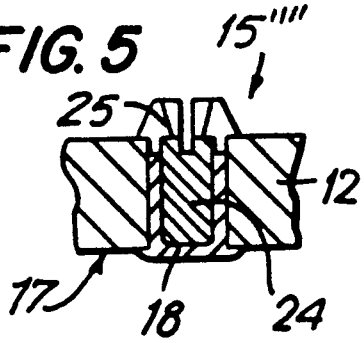
FIG. 6
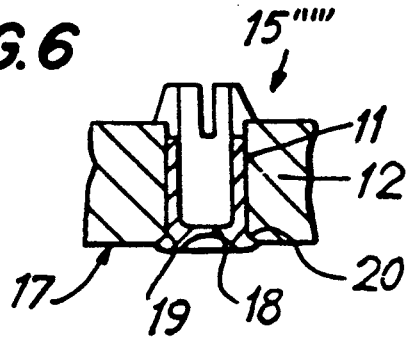

DEVICE ON NEEDLING MACHINES FOR THE PRODUCTION OF NEEDLE-BONDED FABRIC WEBS OR THE LIKE

BACKGROUND OF THE INVENTION

This invention relates to a device used on needling machines for the production of needle-bonded fabric webs or the like, having above the fiber fleece to be needled a holding-down means provided with openings for the needles, said fleece being advanced along a likewise perforated needle plate.

Two parallel perforated plates extending across the entire working width of the machine are located in the needling zone of needling machines. The lower plate is the needle plate into which the needles penetrate in their downward stroke, and the upper plate is the holding-down plate or means through the holes of which the needles pass. The textile fiber fleece to be needled is passed between these two plates, with the barbed needles piercing the fiber fleece and thereby effecting the desired needling. The needles are mounted on a vertically reciprocated needle beam, whereby, depending on the piercing frequency, the air in the needle beam region is moved to a lesser or greater extent. The air masses moved by the needle beam herein pass with considerable acceleration through the holes in the holding-down means and then impinge on the fibers of the fiber fleece, with said fibers being more or less severely unsettled and particularly urged to the side, which results in irregular or irregularly thick and nonhomogeneous needle-bonded fabrics or fleeces, which detracts from the quality thereof.

Furthermore, it has been observed that particularly in the needling of regenerated fibers or of fibers obtained from reconstituted yarn fabrics, said fibers pass through the holes in the holding-down means during the processing, i.e. during the needling, and then collect on the upper side thereof, and this occurs in such great measure that they fill the space between the holding-down means and the needle beam so extensively that this at least leads to disruptions in operation, but often even to serious damage to the machine if it is not shut down and the fibers removed from between the holding-down means and the needle beam promptly enough. This causes a frequent and heavy expenditure for cleaning and supervision, not to mention the machine down times caused thereby.

To avoid the aforementioned disadvantages, i.e. on the one hand, to avoid the undesirable air flow through the holes in the holding down-means and, on the other hand, to avoid the passage of fibers through the holes in the holding-down means, a foam rubber layer covering said holes and pierced by the needles has been provided on the upper side of the holding-down means. The purpose of this foam rubber layer is to strip off fibers clinging to the barbs of the needles as the needles are withdrawn. To ensure the functioning of this construction it is necessary to cover the foam rubber layer on the upper side of the holding down-means with a perforated plate to prevent the foam rubber layer from prematurely wearing out and being destroyed by friction forces. This aforementioned construction is very costly and can only be maintained with considerable effort. Another disadvantage is that stripped off fibers collect in the needle passage openings in the holding-down means and clog them up, so that needle breakage occurs due to fiber clots formed in this way.

OBJECT OF THE INVENTION

The invention is an improvement over the conventional device on needling machines for sealing the holes in the holding-down plate and to prevent the passage of the fibers through these holes with at least equally as good if not better stripping effect and sealing, so that the technical efforts involved in machine maintenance are substantially reduced. In particular down time of the needling machine to a minimum. Moreover, the maintenance work should be quicker and easier to carry out.

For the solution of this problem according to the invention, needling machines of the type in of the type in are provided that have plugs of an elastic material are inserted into the needle passage openings in the holding-down means. The needles are to be plunged through these openings, with said plugs surrounding the needle shafts and with the faces oft he plugs being flush or approximately flush with the underside of the holding-down means.

Additional features of plugs designed according to the invention can be found in the following description of a several preferred embodiments schematically shown in the drawings.

BRIEF DESCRIPTION OF THE DRAWINGS

FIG. 1 shows a side view of the needling zone of a needling machine,

FIG. 2 to FIG. 6 show cross sections through the holding-down means, each in the area of an opening for the needles passing therethrough in their vertically reciprocating movement.

DETAILED DESCRIPTION OF THE DRAWINGS

As seen in FIGS. 1 to 6, one plug 15 each is inserted in each of the openings 11 in the holding-down means 12 located above the fleece 13 to be needled, said fleece being supported by the needle plate 14, with said plug consisting of an elastic material capable of being effortlessly pierced by the needles N and offering only a slight resistance to the needle. The lower face 16 of the plugs 15 inserted into the openings 11 is preferably flush with the underside 17 of the holding-down means 12, particularly in order not to create resistance for fibers gliding along the underside of the holding-down means 12, by means of which an undesirable fiber displacement could be caused. If the absolute flush alignment is not necessary, a condition approaching it should be provided. A slightly set back or concavely arched lower face is equally advantageous.

In the embodiment according to FIG. 2 the plug 15' consists of foamed elastic or a similar, suitable material and is glued into the hole 11 in the holding down-means 12. However, it is also possible to introduce the material, for instance polyurethane foam or the like, in a pasty form into hole. Upon hardening, the mass of foam rubber protruding beyond the outer surfaces of the holding-down means can be removed with a knife. In this manner the desired goal can be substantially reached, even though, if it becomes necessary to change a plug 15', the remnants of the damaged plug must be removed from the hole 11, for instance by means of a special tool, to enable insertion of a new plug. However, if applicable, the plug 15, can also be designed similar to a cigarette filter.

The plug 15'' according to FIG. 3 is cup-shaped and consists of an elastic plastic or, if applicable, of rubber or the like, which is suitable for being pierced by the needle N while retaining its operability over a longer period of time. For instance, silicone rubber can be used as such a particularly well-suited material. The bottom 18 of the cup-shaped plug 15'' is flat and lies flush with the underside 17 of the holding-down means 12. This plug 15'' is also glued into the hole 11. If it is damaged or becomes useless it can be relatively easily removed and replaced with a plug 15'' to be newly glued therein.

Actually, it would be possible to insert the plug 15'' into the hole 11 upside down, i.e. the bottom would be flush with the upper side of the holding-down means 12; however, this presents the risk of fiber material collecting in the hollow space of the plug 15'', which material can then be pulled upwardly, destroying the bottom of the plug 15'' and giving rise to a disruption in operation. Therefore, it is more advantageous to dispose the bottom 18 of the plug 15'' as shown in FIG. 3.

However, as shown in FIGS. 4, 5 and 6, it is also possible to securely clamp the plugs 15''', 15'''' and 15'''' in the holes 11 or on the holding-down means 12. This is done by means of an outer collar 19 near the bottom 18 of the plug, either lying in a recess 20 in the underside 17 of the holding-down means 12 or, as shown in FIG. 5, abutting the underside 17 of the holding-down means 12. In this case, the bottom 18 of the plug 15''' protrudes slightly beyond the underside 17 of the holding-down means 12, which, under certain circumstances, would not be harmful.

Upon the exertion of a vertical upward pulling force, the plug 15''' is held fast by the collar 19. An additional collar 21 is disposed at the upper end of the plug 15''', said collar having a tapered face 22 and slots 23 to enable the plug to be quickly and easily inserted into a hole 11, wherein it engages with its collar 21 on the hole's rim and braces itself against the upper side of the holding-down means 12.

As seen in FIG. 5, the inner space of the plug 15'''' can, if applicable, be filled with a foam rubber stopper 24. To axially secure this, a collar 25 at the upper end of the plug 15'''' projects inwardly and the stopper 24 can brace itself against said collar when subjected to an upward pulling force.

In the plug 15'''' shown in FIG. 6, which substantially corresponds to that of FIG. 4, the underside of the bottom 18 is arched inwardly towards the hollow space of the plug. This offers the advantage that burrs or similar roughness resulting from fraying and possibly forming due to the repeated penetration of the bottom 18 is set back from the underside 17 of the holding-down means 12, so that an undesired snagging of fibers of the fleece can be avoided.

If applicable, it can be advantageous to provide the bottom of the cup-shaped plugs 15'', 15''', 15'''' and 15''''' with a fine hole 26 (FIG. 4) at the point through which the needle N can pass. The purpose of this is that the barbs on the needles are less quickly worn out upon passing through the bottom 18.

What we claim is:

1. A device on needling machines for the production of needle-bonded fabric webs or the like, having above a fiber fleece to be needled comprising: a holding-down means having an underside provided with openings of a cylindrical shape for needles which include needle shafts, with said fiber fleece being advanced along a likewise perforated needle plate, and plugs, each of said plugs being of cylindrical shape and having an outer diameter and having a lower face of elastic material, each said plug plug to be pierced by a needle, and are inserted into the needle openings of said holding-down means, with said plugs surrounding the needle shafts, the lower face of said plugs being flush or approximately flush with the underside of said holding-down means.

2. A device according to claim 1, wherein said plugs consist of a foamed or fibrous or similar material and fill in said openings in said holding-down means.

3. A device according to claim 1, wherein said plugs are cup-shaped and have a cylindrical wall and a thin bottom.

4. A device according to claim 3, wherein said plugs have an inner side and an outer side, and wherein the outer side of said bottom lies in the plane of the underside of said holding-down means.

5. A device according to claim 3, wherein the outer side of said bottom lies slightly inwardly of the plane of said underside of said holding-down means.

6. A device according to claim 3, 4 or 5, wherein the hollow space of said plugs is filled in with foamed or similar material.

7. A device according to one of claims 1 to 5, further including a plurality of collars and wherein said plugs have two ends and wherein one collar each is located on the two ends of said plugs, with the outer diameters thereof being greater than the diameter of the openings in said holding-down means and with said plugs being thereby axially fixed relative to said holding-down means.

8. A device according to claim 7, wherein the collars have facing surfaces, the holding-down mans have lower and upper side, and wherein the facing surfaces of said collars abut the respective lower and upper sides of said holding-down means.

9. A device according to claim 7, wherein said collars include a lower collar, said holding-down means has an underside and wherein the lower collar lies in a recess in the underside of said holding-down means.

10. A device according to claim 2 or 3 wherein said plugs are glued into the openings in said holding-down means.

11. A device as in any of claims 3 to 5, wherein a central opening for the needle is provided in the bottom of said plugs, with the diameter of said opening corresponding approximately to that of the needle shaft.

* * * * *